US011298952B2

(12) United States Patent
Mizutani et al.

(10) Patent No.: US 11,298,952 B2
(45) Date of Patent: Apr. 12, 2022

(54) PRINTING SYSTEM

(71) Applicant: SEIKO EPSON CORPORATION, Tokyo (JP)

(72) Inventors: Tadahiro Mizutani, Shiojiri (JP); Taku Ishizawa, Matsumoto (JP); Ryoichi Tanaka, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 5 days.

(21) Appl. No.: 17/083,821

(22) Filed: Oct. 29, 2020

(65) Prior Publication Data

US 2021/0129551 A1 May 6, 2021

(30) Foreign Application Priority Data

Oct. 30, 2019 (JP) ..... JP2019-197126

(51) Int. Cl.
*B41J 2/175* (2006.01)
*B41L 45/06* (2006.01)

(52) U.S. Cl.
CPC ..... *B41J 2/17566* (2013.01); *B41J 2/1752* (2013.01); *B41J 2/17509* (2013.01); *B41J 2/17546* (2013.01); *B41L 45/06* (2013.01)

(58) Field of Classification Search
CPC ..... B41J 2/175; B41J 2/17509; B41J 2/1752; B41J 2/17546; B41J 2/17566; B41J 29/13; B41L 45/06
See application file for complete search history.

(56) References Cited

U.S. PATENT DOCUMENTS

| | | | | |
|---|---|---|---|---|
| 5,970,273 | A * | 10/1999 | Zenk | G03G 15/104 399/12 |
| 7,422,302 | B2 | 9/2008 | Tanaka | |
| 8,033,633 | B2 | 10/2011 | Umeda | |
| 8,708,448 | B2 * | 4/2014 | Nakamura | B41J 2/17546 347/19 |
| 2005/0128239 | A1 | 6/2005 | Tanaka | |
| 2008/0198188 | A1 | 8/2008 | Umeda | |
| 2009/0153603 | A1 * | 6/2009 | Mantell | B41J 2/17593 347/7 |
| 2019/0299625 | A1 | 10/2019 | Mizutani et al. | |

FOREIGN PATENT DOCUMENTS

| | | | |
|---|---|---|---|
| JP | 3838240 | B2 | 10/2006 |
| JP | 2008-200955 | A | 9/2008 |
| JP | 2017-222152 | A | 12/2017 |
| JP | 2019-038170 | A | 3/2019 |
| JP | 2019-098526 | A | 6/2019 |
| WO | 03/082582 | A1 | 10/2003 |

* cited by examiner

*Primary Examiner* — Anh T Vo
(74) *Attorney, Agent, or Firm* — Oliff PLC

(57) ABSTRACT

The printing system includes a liquid supply container that stores a liquid; a printing device that receives a liquid supplied from the liquid supply container and performs printing; an imaging device that acquires image information including at least a part of the liquid supply container; an acquisition section that acquires reference information; a determination section that collates the image information with the reference information and determines whether or not the liquid is allowed to be supplied according to a collation result; and a control section that controls the printing device according to the determination.

12 Claims, 9 Drawing Sheets

PRINTING SYSTEM

The present application is based on, and claims priority from JP Application Serial Number 2019-197126, filed Oct. 30, 2019, the disclosure of which is hereby incorporated by reference herein in its entirety.

BACKGROUND

1. Technical Field

The present disclosure relates to a printing system.

2. Related Art

Ink has been replenished by using a consumable item such as an ink cartridge or an ink bottle in the related art. For example, as described in International Publication No. WO 2003/082582, a technique is known in which in replacement of the ink cartridge, color information of the ink cartridge or the like is recognized by using a radio tag of the ink cartridge to move a carriage according to the information and position the ink cartridge whose replacement is required to a replacement position. Further, as described in JP-A-2017-222152, a technique is known in which an ink bottle having an uneven portion and corresponding to an ink inlet port of a printer can be properly coupled by fitting the ink bottle to an uneven portion of an ink tank using the ink bottle.

However, when a container such as an ink cartridge or an ink bottle, which is a consumable item, has a radio tag, an IC chip, or the like, plastics and metals coexist, resulting in large burden on environment when discarded. When a plastic container with unevenness is discarded, the disposal amount increases and burden on environment increases. Therefore, a printing system using an environment-friendly consumable item is desired.

SUMMARY

According to an aspect of the present disclosure, there is provided a printing system. The printing system includes a liquid supply container that stores a liquid; a printing device that receives a liquid supplied from the liquid supply container and performs printing; an imaging device that acquires image information including at least a part of the liquid supply container; an acquisition section that acquires reference information; a determination section that collates the image information with the reference information and determines whether or not the liquid is allowed to be supplied according to a collation result; and a control section that controls the printing device according to the determination.

DESCRIPTION OF EXEMPLARY EMBODIMENTS

A. First Embodiment

Figure 1:
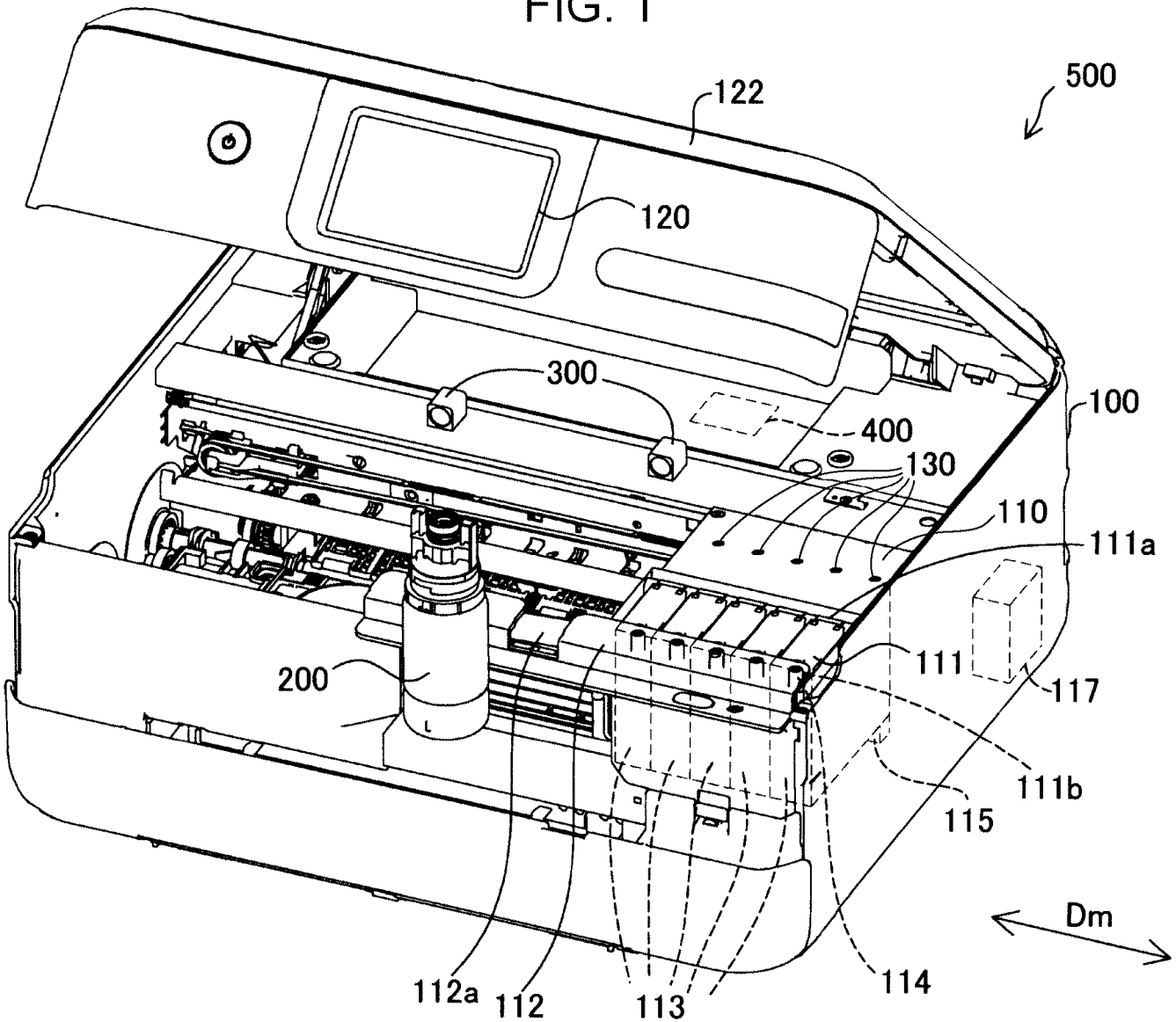
FIG. 1 is an explanatory diagram illustrating an example of a printing system.
Figure 2:
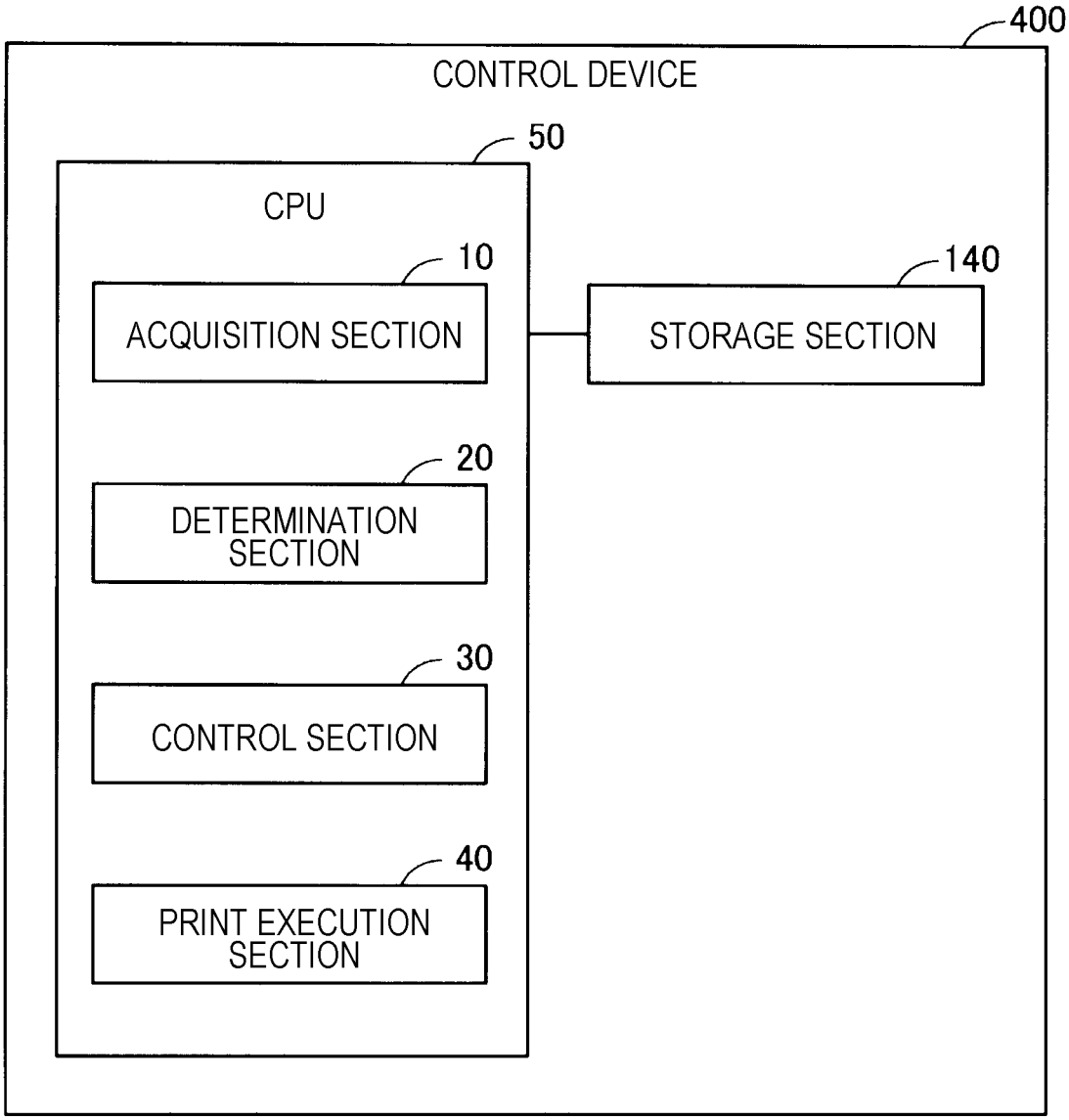
FIG. 2 is an internal block diagram of a printing device.

FIG. 1 is an explanatory diagram illustrating an example of a printing system 500 according to a first embodiment. FIG. 2 is an internal block diagram of a printing device 100 according to the first embodiment. As illustrated in FIG. 1, the printing system 500 includes the printing device 100 and a liquid supply container 200 which is an example of a consumable item. The liquid supply container 200 is a consumable item of the printing system 500. The printing device 100 is an ink jet printer that receives a liquid supplied from the liquid supply container 200 storing the liquid and performs printing. Specifically, in the printing device 100, the liquid is filled from the liquid supply container 200 to a liquid container 113 disposed on a carriage 110, and the liquid filled into the liquid container 113 is supplied to a print head 115 to perform printing on a print medium. Further, the printing device 100 is an on-carriage type printer having the liquid container 113 mounted on the carriage 110. The carriage 110 reciprocates in a main scanning direction Dm when a printing operation is performed. The main scanning direction Dm is a width direction of the print medium on which printing is performed.

A plurality of liquid containers 113 are provided. In the present embodiment, five liquid containers 113 are provided. Three of the five liquid containers 113 store cyan ink, magenta ink, and yellow ink, and the other two liquid containers 113 store black ink. When the printing device 100 is in an initial state or a liquid in the liquid container 113 is consumed, the liquid container 113 is replenished with the liquid using the corresponding liquid supply container 200. Five types of liquid supply containers 200 corresponding to the five liquid containers 113 are prepared, for example.

The printing device 100 includes a control device 400, an imaging device 300, a carriage 110, a lock mechanism 112, a notification section 120, and a waste liquid tank 117. As illustrated in FIG. 2, the control device 400 includes a storage section 140 constituted by a RAM and a ROM, and a CPU 50. The CPU 50 functions as an acquisition section 10, a determination section 20, a control section 30, and a print execution section 40 by executing a program installed in the storage section 140 in advance. However, some or all of the functions of these sections may be realized by a hardware circuit.

As illustrated in FIG. 1, the imaging device 300 is a camera that captures an image including image information for identifying the liquid supply container 200. The imaging device 300 is exposed when a cover 122 on an upper portion of the printing device 100 is opened. It is preferable that a plurality of imaging devices 300 are provided to image the liquid supply container 200 from a plurality of angles. Further, it is preferable that the imaging device 300 is rotatable so as to switch an area of an object to be imaged between a state where the liquid supply container 200 and the printing device 100 are not coupled to each other and a state where the liquid supply container 200 and the printing device 100 are coupled to each other. In the present embodiment, the imaging device 300 is included in the printing device 100, but may be provided on a smartphone having a camera or a mobile phone, or may be provided to be attachable to and detachable from the printing device 100. The image information includes information for identifying which liquid container 113 corresponds to the liquid supply container 200. For example, the image information includes at least one of the following information for identifying the liquid supply container 200.

First Information

Information regarding an outer appearance of the liquid supply container 200

Second Information

Color information of the liquid supply container 200 regarding a color of a stored ink, such as a film or label having a portion printed in the color of the stored ink, a film or label on which character information representing the color is printed, or at least a part of the liquid supply container which is dyed in the color of the stored ink, and the like Third Information Character information of the liquid supply container 200, such as a product number of the liquid supply container 200

Fourth Information

Code information of the liquid supply container 200, such as a QR code (registered trademark) including information regarding the liquid supply container 200

Fifth Information

Information of the liquid supply container 200 regarding a member reflecting infrared rays The five types of liquid supply containers 200 corresponding to the five liquid containers 113 are configured to be identifiable by at least one of the first to fifth information. For example, when the liquid supply container 200 is configured to be identifiable by the first information, the five types of liquid supply containers 200 have different outer appearances. For example, when the liquid supply container 200 is configured to be identifiable by the second information, there is color information representing a color of the ink stored in the liquid supply container 200 on an outer surface. For example, when the liquid supply container 200 is configured to be identifiable by the third information, there is character information corresponding to each type of the liquid supply container 200 on an outer surface. For example, when the liquid supply container 200 is configured to be identifiable by the fourth information, there is code information corresponding to each type of the liquid supply container 200 on an outer surface. For example, when the liquid supply container 200 is configured to be identifiable by the fifth information, there is information regarding a member reflecting infrared rays having different sizes or shapes according to each type of the liquid supply container 200.

Image information can be acquired by appropriately combining the first to five information or other information. The image information can be acquired from an image captured by the imaging device 300 using a known image analysis technique.

The acquisition section 10 acquires reference information stored in the storage section 140. The reference information is information using when the determination section 20 performs determination as a reference, for example, reference image information. The reference information may be stored in a device outside the printing device 100. The determination section 20 collates the image information acquired by the imaging device 300 with the reference information acquired by the acquisition section 10, and determines whether or not the liquid is supplied from the liquid supply container 200 according to the collation result. The determination section 20 performs collation using a known technique such as pattern matching, for example. The control section 30 controls the printing device 100 according to the determination of the determination section 20. For example, the control section 30 controls various operations of the printing device 100 when the liquid is filled from the liquid supply container 200 to the liquid container 113 according to the determination of the determination section 20. The print execution section 40 performs control for printing. Details of the determination contents of the determination section 20 will be described below.

As illustrated in FIG. 1, the carriage 110 includes the five liquid containers 113, five cover members 111, the print head 115, and five lighting sections 130. The five liquid containers 113 communicate with the print head 115 and store an ink to be supplied to the print head 115. The print head 115 mounted on the carriage 110 ejects the ink stored in each liquid container 113 toward, for example, a print medium. Each liquid container 113 has a liquid fill port 114, as a liquid inlet port, into which the liquid is filled from the outside and flows. The liquid fill port 114 communicates with the print head 115. The liquid fill port 114 may be a hole having an inlet port provided on an exterior member mounted so as to cover at least a part of a top surface of the liquid container 113 or a plane of an adapter, or may be a conduit provided along a center axis of the hole. When the liquid fill port 114 is a conduit, the conduit may further protrude to the outside from an inlet port of the hole, or may be provided so that a tip is positioned to be retracted inside the hole. Further, when the outer member or the adapter is not provided, a tubular conduit as the liquid fill port 114 may protrude from a wall of the liquid container 113, or the hole as the liquid fill port 114 may be formed on a wall of the liquid container 113. In the present embodiment, the liquid fill port 114 as a liquid inlet port communicates with the print head 115 via the liquid container 113. The number of the liquid containers 113, the number of the cover members 111, and the number of lighting sections 130 are not limited to five, and may be one or more.

The cover member 111 is provided on the corresponding liquid container 113. The cover member 111 is a lever capable of switching the cover member 111 between two states of a closed state where the liquid fill port 114 of the liquid container 113 is covered and an open state where the liquid fill port 114 is exposed. In the cover member 111, the closed state and the open state can be switched by allowing a user to rotate an operation section 111*b*, which is the other end portion, with one end portion 111*a* as a fulcrum.

The five lighting sections 130 are light source devices provided at positions corresponding to the five liquid containers 113, respectively. In the lighting section 130, a lighting-on state and a lighting-off state are switched under the control of the control section 30.

The lock mechanism 112 is a mechanism capable of switching the cover member 111 between a first state where the cover member 111 cannot transition from the closed state to the open state and a second state where the cover member 111 can transition from the closed state to the open state. In the present embodiment, the lock mechanism 112 is a plate-like member provided above the carriage 110, and can attain the first state by restricting the operation of the user to the operation section 111*b* due to the cover of the operation section 111*b*. The plate-like member has an opening 112*a* for exposing the operation section 111*b*.

In FIG. 1, the printing device 100 is in a stopped state where the printing operation is not executed, and in this state, the carriage 110 is positioned at a home position on one end portion of the printing device 100 in the main scanning direction Dm. Since the entire operation section 111*b* is covered with the lock mechanism 112 at the home position of the carriage 110, the user cannot fill the liquid from the liquid supply container 200 to the liquid container 113. On the other hand, when the liquid container 113 to which the liquid supply container 200 is coupled, that is, the liquid container 113 to be replenished with the liquid is specified according to the determination of the determination section 20, the control section 30 moves the carriage 110 so that the opening 112*a* is positioned on the target cover member 111 in order to make the cover member 111 covering the specified liquid container 113 be in the second state. As a result, the control section 30 switches the lock mechanism 112 from the first state to the second state. The printing device 100 may not include the lock mechanism 112.

The notification section 120 notifies a user of replenishment of the liquid or related information using a residual amount of liquid under the control of the control section 30. The related information includes, for example, a time required for replenishment of the liquid, the number of times of printing when the liquid in the liquid supply container 200 is completely replenished, and whether or not an amount of liquid in the liquid container 113 enables the completion of the replenishment. In the present embodiment, the notification section 120 is a display device, but not limited to this, for example, a voice device such as a speaker may be used.

The waste liquid tank 117 is a container that stores a liquid ejected from the print head 115 and not used for printing. For example, the waste liquid tank 117 communicates with a cleaning mechanism (not illustrated) that sucks the liquid from the print head 115. The liquid in the print head 115 sucked by the cleaning mechanism circulates in the waste liquid tank 117. The waste liquid tank 117 is a replaceable attaching/detaching member and is a consumable item that is replaced with a new waste liquid tank 117 when a predetermined amount of liquid is stored.

Figure 3:
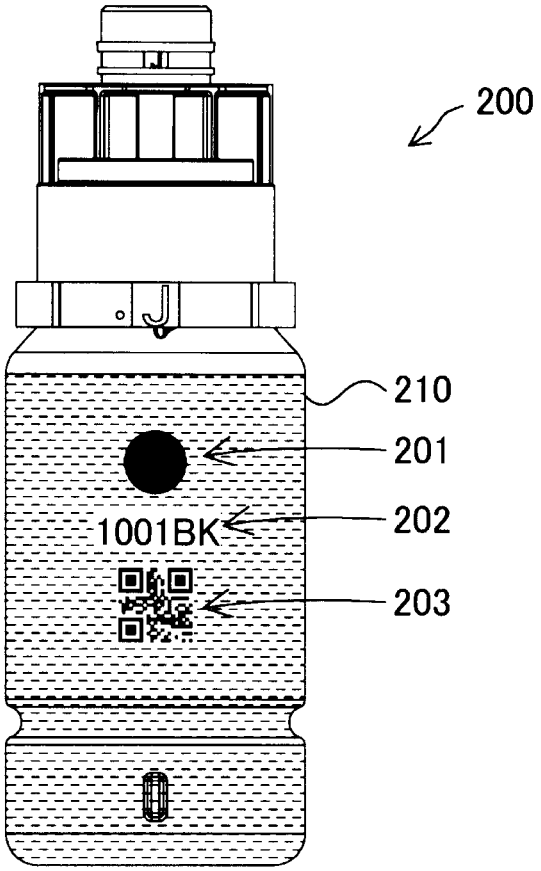
FIG. 3 is an explanatory diagram illustrating an example of a liquid supply container.

FIG. 3 is an explanatory diagram illustrating an example of the liquid supply container 200 according to the present embodiment. The liquid supply container 200 is a container that stores a liquid. In the present embodiment, the liquid supply container 200 includes a transparent or translucent wall portion 210 that allows the residual amount of the stored liquid to be visually recognized. Further, in the present embodiment, color information 201, character information 202, and code information 203, which are related to the stored liquid, are printed on the liquid supply container 200.

Figure 4:
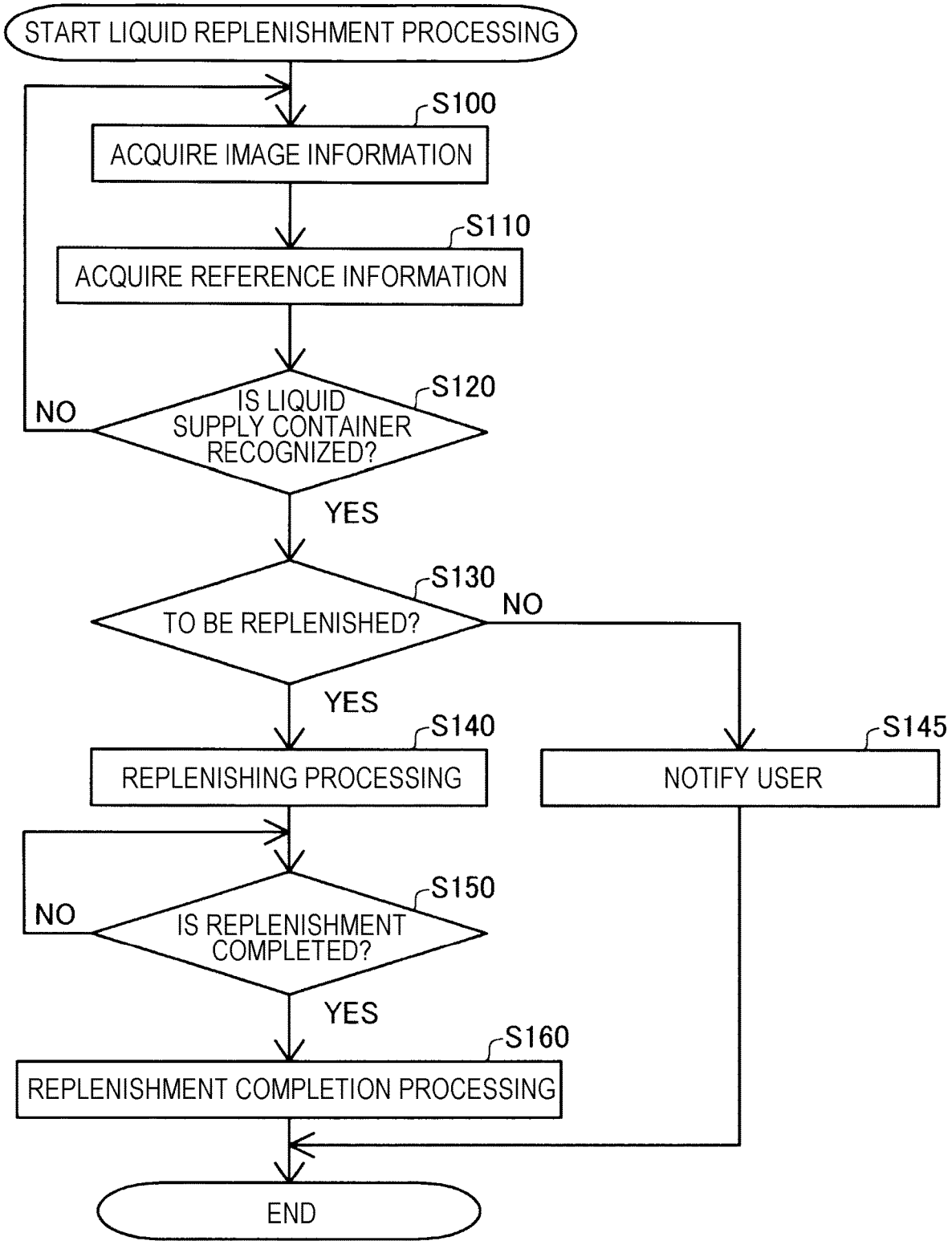
FIG. 4 is a flowchart illustrating an example of a procedure of liquid replenishment processing.
Figure 5:
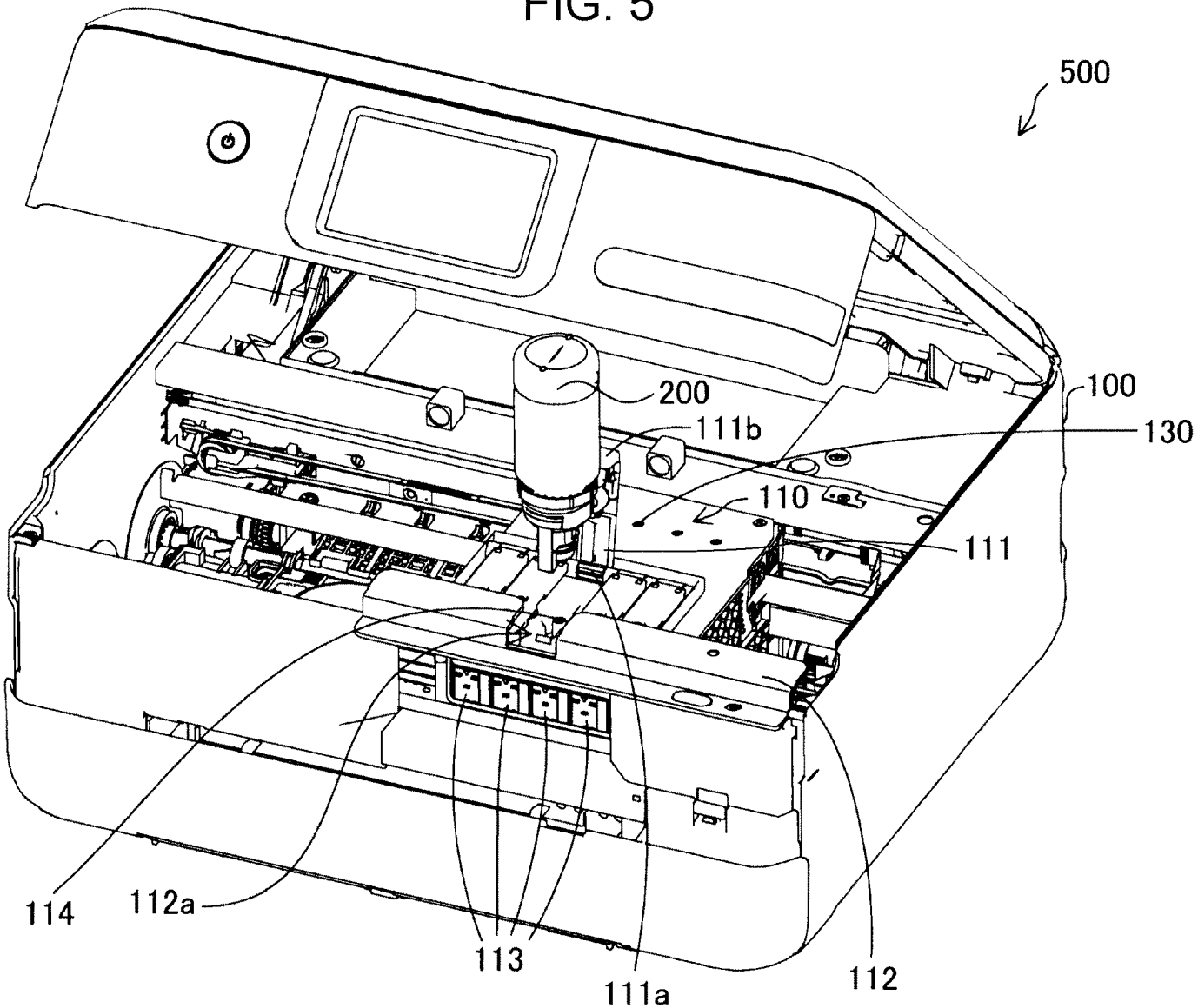
FIG. 5 is an explanatory diagram illustrating an example of replenishing processing.

FIG. 4 is a flowchart illustrating an example of a procedure of liquid replenishment processing. FIG. 5 is an explanatory diagram illustrating an example of replenishing processing. The liquid replenishment processing is for supplying the liquid stored in the liquid supply container 200 to the liquid container 113. The liquid replenishment processing is started when a user opens the cover 122 illustrated in FIG. 1. Note that a condition of the liquid to be replenished is set in advance at the time of starting this processing. For example, the condition is that the control device 400 detects a small residual amount of liquid in the liquid container 113. For the detection of the residual amount of liquid, a known technique, for example, a technique of optically detecting the residual amount of liquid can be adopted.

As illustrated in FIG. 4, the imaging device 300 acquires image information in Step S100. More specifically, the imaging device 300 captures an image at a predetermined interval to acquire the captured image, and acquires the image information from the captured image. Next, the acquisition section 10 acquires reference information in Step S110. Note that Step S100 and Step S110 are not limited to this order, but can be performed in any order, and may be performed in parallel. Further, Step S110 may be performed after Step S120 described below.

Subsequently, the determination section 20 determines in Step S120 whether or not the liquid supply container 200 can be recognized from the captured image acquired in Step S100. That is, for example, the user determines whether or not to dispose the liquid supply container 200 in the area of an object to be imaged by the imaging device 300. When the liquid supply container 200 can be recognized, the processing proceeds to Step S130. On the other hand, when the liquid supply container 200 cannot be recognized, the processing returns to Step S100. That is, the printing system 500 repeats the processing of Steps S100 to S120 until the liquid supply container 200 can be recognized. When a predetermined time has elapsed, the liquid replenishment processing may be ended.

The determination section determines in Step S130 whether or not the recognized liquid supply container 200 can be replenished with the liquid in the liquid container 113 to be replenished with the liquid. More specifically, the determination section 20 collates the image information of the liquid supply container 200 recognized in Step S120 with the reference information acquired in Step S110 and determines whether or not the liquid supply container 200 corresponds to the liquid container 113 to be replenished. For example, it is possible to adopt at least one or more conditions including first condition among the following conditions as determination conditions. The determination conditions are set in advance when the liquid replenishment processing is started.

First Condition

The liquid supply container 200 stores a liquid having a predetermined color.

Second Condition

The liquid supply container 200 stores a liquid equal to or more than a predetermined amount.

Third Condition

The liquid supply container 200 is a regular product.

It is possible to determine whether or not the first condition is satisfied using, for example, the second information in the image information.

It is possible to determine whether or not the second condition is satisfied by obtaining the amount of liquid stored in the liquid supply container 200 using, for example, the first information in the image information and the image information acquired in Step S100.

It is possible to determine whether or not the third condition is satisfied using, for example, the third information or the fourth information in the image information.

The determination condition can be made by appropriately combining the first condition and the second and third conditions or other conditions. The determination condition may be stored in the storage section 140 or may be stored in a device outside the printing device 100.

When the determination section 20 determines in Step S130 that the replenishment cannot be made, that is, the determination condition has not been satisfied, the processing proceeds to Step S145 and the control section 30 controls the notification section 120 to notify the user that the liquid supply container 200 does not store ink to be replenished, and the liquid replenishment processing is thus ended. On the other hand, when the determination section 20 determines that the replenishment can be made, that is, when the determination condition is satisfied, the processing proceeds to Step S140 and the control section 30 performs replenishing processing.

In the replenishing processing, the control section 30 controls the printing device 100 to replenish the liquid from the liquid supply container 200 to the liquid container 113 to be replenished. Specifically, as illustrated in FIG. 5, the control section 30 moves the carriage 110 so that the cover member 111 covering the liquid fill port 114 of the liquid container 113 to be replenished, that is, the target cover member 111 can be opened and closed. More specifically, the control section 30 moves the carriage 110 so that the operation section 111*b* of the target cover member 111 overlaps the opening 112*a*. As a result, the cover member 111 covering the liquid fill port 114 of the liquid container 113 to be replenished can be switched from the closed state to the open state through the opening 112*a*. Further, the control section 30 lights the lighting section 130 provided at a position corresponding to the liquid container 113 to be replenished to inform the user of the liquid container 113 to be replenished. In the replenishing processing, the control section 30 may be notified by the notification section 120 of information regarding a coupling method of the liquid supply container 200 and the liquid container 113, for example, a position of the liquid fill port 114, or a coupling procedure of the liquid fill port 114 and the liquid supply container 200.

Further, in the replenishing processing, the control section 30 may control the notification section 120 to notify the user of the related information. For example, during the processing of Step S120, the determination section 20 determines information regarding the residual amount of liquid in the liquid supply container 200 based on the image information, and calculates a time when the residual amount of liquid is filled into the liquid container 113 at a predetermined filling amount, that is, a time required for replenishment. Then, the control section 30 may be notified by the notification section 120 of the calculated time required for replenishment. Further, the control section 30 may control the notification section 120 to notify the user of a guide suitable for replenishment work according to the captured image acquired by the imaging device 300, the captured image including an image showing a coupling state of the liquid supply container 200 and the liquid fill port 114 as the liquid inlet port.

Subsequently, the printing device 100 determines in step S150 whether or not the replenishment is completed, as illustrated in FIG. 4. The printing device 100 determines that the replenishment is completed when the user presses a replenishment completion button, for example. When the replenishment is completed, the processing proceeds to Step S160. On the other hand, when the replenishment is not completed, the printing device 100 returns to the processing of Step S150. That is, the processing of Step S150 is repeated until the replenishment is completed.

Finally, the control section 30 performs the replenishment completion processing in Step S160. The replenishment completion processing is control processing performed by the control section 30 when the replenishment of the liquid from the liquid supply container 200 is completed. As the replenishment completion processing, for example, any one or more of the following processing can be adopted.

First Processing

The carriage 110 is returned to the home position

Second Processing

The replenishment completion is notified by the notification section 120

Third Processing

The lighting section 130 that has been lit is turned off

The replenishment completion processing can be made by appropriately combining the first to third processing or other processing. The replenishment completion processing is determined according to the replenishing processing in Step S140.

According to the printing system 500 of the present embodiment described above, since it can be determined whether or not the liquid can be supplied from the liquid supply container 200 using the image information acquired by the imaging device 300, the control section 30 performs determination without having a radio tag on the liquid supply container 200 and an uneven shape for determination. Therefore, an environment-friendly consumable item, specifically, the liquid supply container 200 can be used.

Since the image information includes the color information 201, the character information 202, and the code information 203, the control section 30 can accurately perform determination whether or not the liquid is supplied.

Since the printing system 500 includes a plurality of imaging devices 300, it is possible to image the liquid supply container 200 from a plurality of angles. Therefore, image information with higher accuracy can be acquired. Furthermore, by imaging the liquid supply container 200 from the plurality of angles, the determination section 20 can generate third-dimensional information on the liquid supply container 200 by using the captured image. As a result, when the actual liquid supply container is a three-dimensional liquid supply container 200 even if a photograph is shown that the liquid supply container 200 is in front of the imaging device 300, it is possible to prevent the determination section 20 from performing false recognition.

In the replenishing processing, since the control section 30 moves the carriage 110 to a coupling position where the liquid supply container 200 and the liquid container 113 can be coupled, it is possible to easily recognize a position where the user couples the liquid supply container 200.

Since the captured image includes an image showing the coupling state between the liquid supply container 200 and the liquid container 113, the user can acquire the replenishment work in real time. Therefore, it is possible to perform the guide suitable for the user's work.

Since the notification section 120 notifies the information regarding the coupling method of the liquid supply container 200 and the liquid container 113 according to the determination of the control section 30, it is possible to assist the user's replenishment work. Therefore, it is possible to prevent the user from performing the wrong work.

Since the lighting section 130 indicates a position of the liquid container 113 to which the liquid supply container 200 is coupled, the position where the user couples the liquid supply container 200 can be easily recognized.

Further, the liquid container 113 to which the liquid supply container 200 is coupled can be replenished with the liquid according to the determination of the determination section 20, such that the control section 30 moves the carriage 110 so that the cover member 111 can be opened and closed. As a result, it is possible to prevent the user from coupling the liquid supply container 200 to the liquid fill port 114 of the liquid container 113 that is not the original liquid container to be replenished.

B. Second Embodiment

Figure 6:
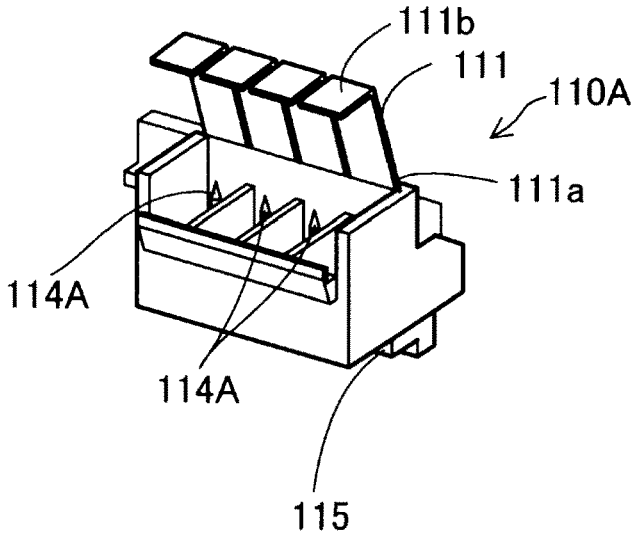
FIG. 6 is an explanatory diagram illustrating a carriage according to a second embodiment.

FIG. 6 is an explanatory diagram illustrating a carriage 110A according to a second embodiment. The printing device 100 according to the second embodiment differs from the printing device in the first embodiment in that the carriage 110A is provided with a liquid supply container that can be attachable to and detachable from the carriage 110A instead of the liquid container 113, and other configurations are the same. As illustrated in FIG. 6, the carriage 110A has a liquid inlet port 114A that communicates with the print head 115 and into which a liquid flows. The liquid inlet port 114A has a tubular shape and is coupled to the liquid supply container. Thus, the liquid is supplied from the liquid supply container to the liquid inlet port 114A. Further, the carriage 110A has a cover member 111 for attaching and detaching the liquid supply container to and from the carriage 110A, and a lighting section 130 (not illustrated).

Figure 7:
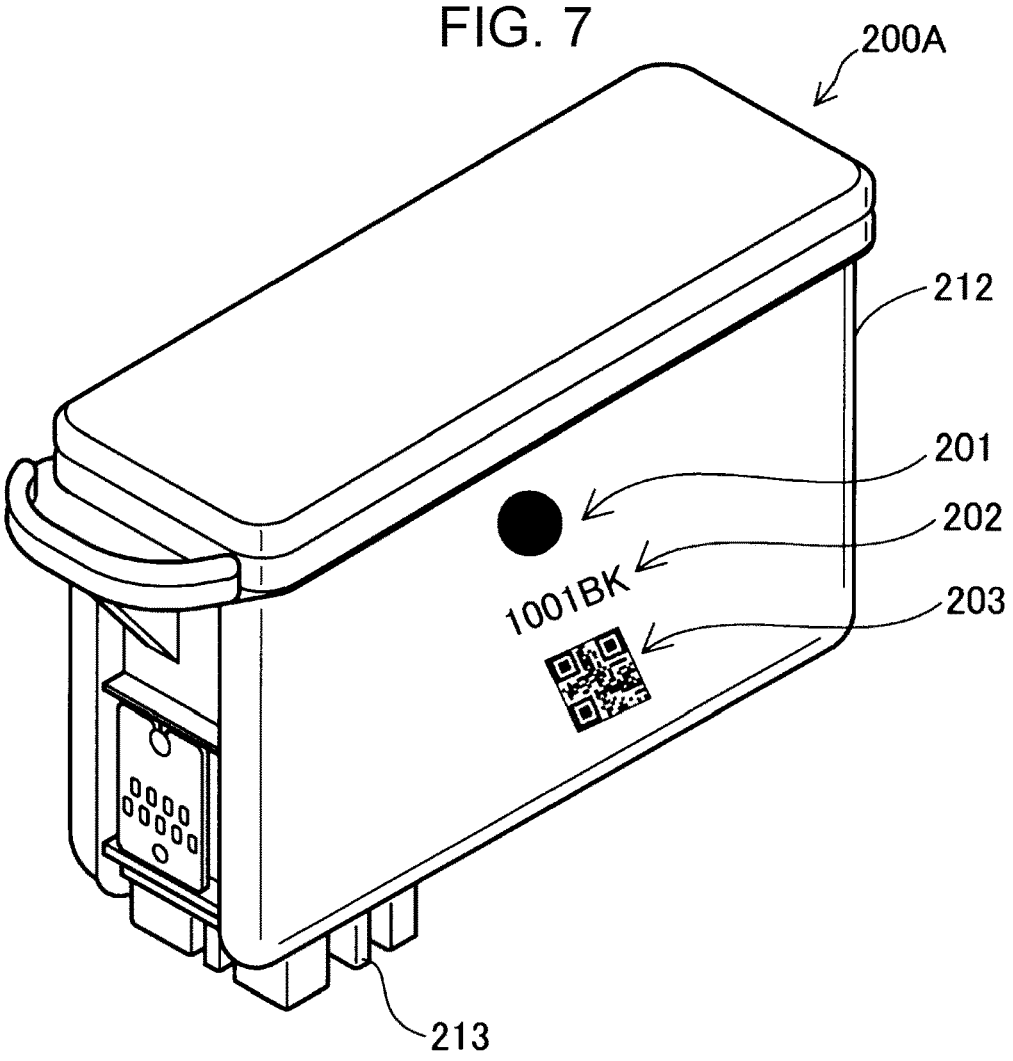
FIG. 7 is an explanatory diagram illustrating a liquid supply container according to the second embodiment.

FIG. 7 is an explanatory diagram illustrating a liquid supply container 200A according to the second embodiment. In the second embodiment, the liquid supply container 200A is a cartridge that can be attached to and detached from the carriage 110A. The liquid supply container 200A includes a container body 212 that stores the liquid, and a liquid supply port 213 that supplies the liquid in the container body 212 to the outside. Since the liquid supply port 213 is coupled to the liquid inlet port 114A, the liquid in the container body 212 is supplied to the liquid inlet port 114A through the liquid supply port 213. Unlike the first embodiment, in the present embodiment, the liquid inlet port 114A communicates with the print head 115 without through the liquid container 113, and the liquid is supplied to the print head 115. The liquid supply container 200A includes, for example, color information 201, character information 202, and code information 203 which are printed on a side surface of the container body 212.

According to the printing system 500 of the present embodiment described above, since it can be determined whether or not the liquid can be supplied from the liquid supply container 200A by using the image information acquired by the imaging device 300, the control section 30 performs determination without having a radio tag on the liquid supply container 200A and an uneven shape for determination. Therefore, an environment-friendly consumable item, specifically, the liquid supply container 200A, which is a cartridge, can be used.

C. Third Embodiment

Figure 8:
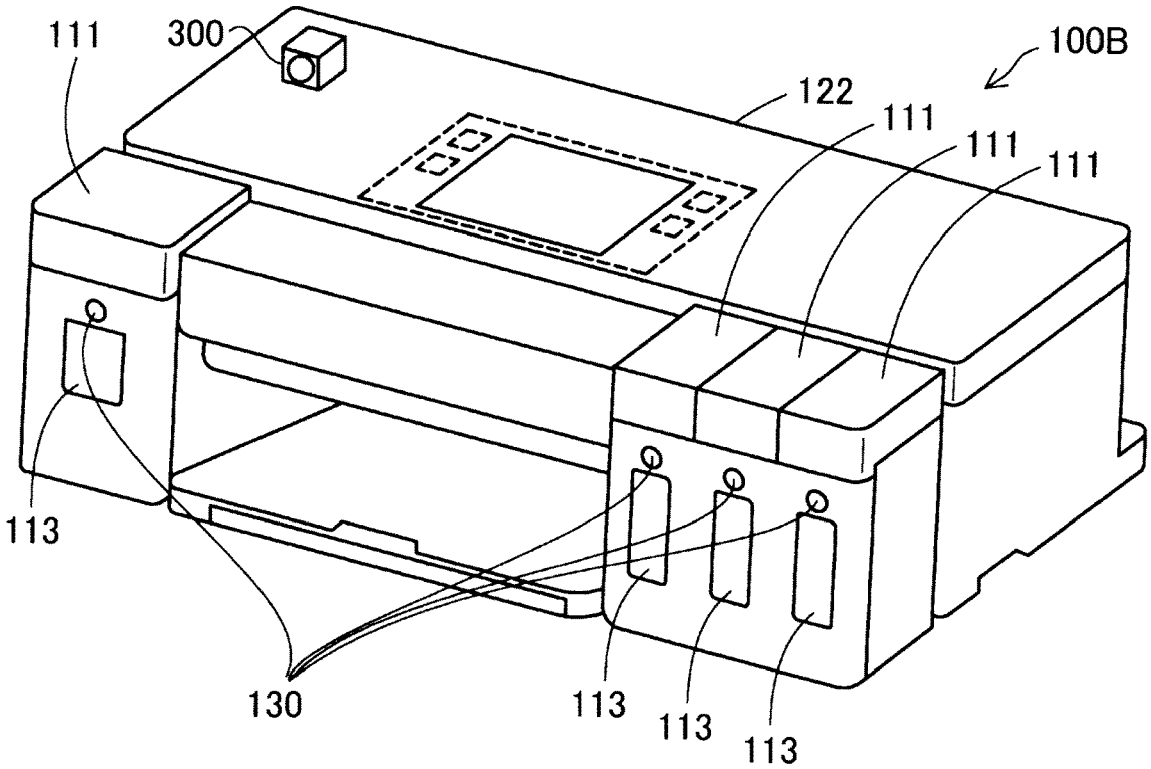
FIG. 8 is an explanatory diagram illustrating a printing device according to a third embodiment.

FIG. 8 is an explanatory diagram illustrating a printing device 100B according to a third embodiment. The printing device 100B according to the third embodiment differs from the printing device in the first embodiment in that: the printing device 100B is an off-cartridge printer including the liquid container 113 at a different position from the carriage 110; the printing device 100B includes the imaging device 300 outside the cover 122; and the printing device 100B includes the lock mechanism 112B, and other configurations are the same.

Figure 9:
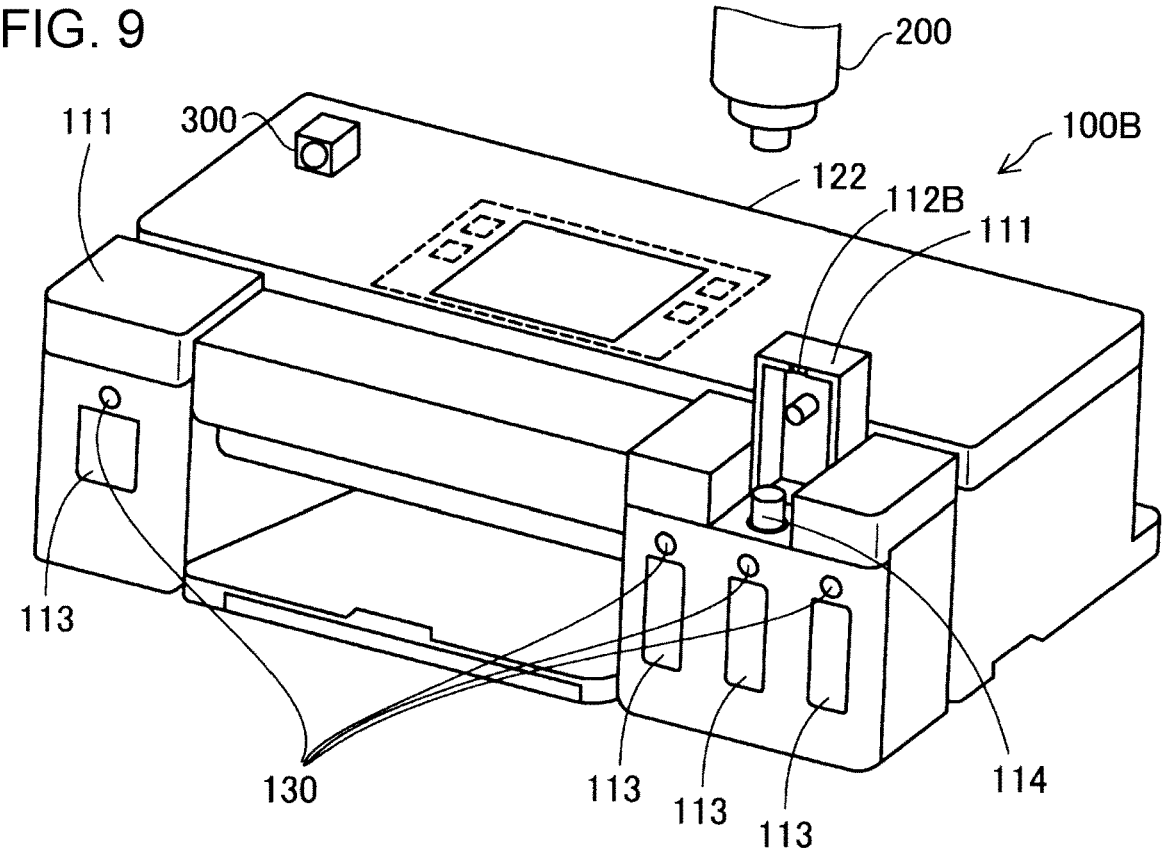
FIG. 9 is an explanatory diagram illustrating an example of liquid replenishment processing according to the third embodiment.

FIG. 9 is an explanatory diagram illustrating an example of the liquid replenishment processing according to the third embodiment. In the third embodiment, the user brings the liquid supply container 200 illustrated in FIG. 3 closer to an imaging area of the imaging device 300, for example, in front of the imaging device 300, and allows the determination section 20 to recognize the liquid supply container 200. In the replenishing processing, the control section 30 switches the lock mechanism 112B to the second state, and thus makes the cover member 111 covering the liquid container 113 to be replenished be in the open state. The lock mechanism 112B is an engagement mechanism provided on the cover member 111, and the engagement mechanism is displaced by the control section 30 such that the engagement with a main body of the printing device 100B can be released. In the third embodiment, a line head may be adopted as the print head, the line head not being mounted on the carriage 110 and having liquid ejecting nozzles disposed over the entire region in a width direction of printing paper.

According to the printing system 500 of the present embodiment described above, since it can be determined whether or not the liquid can be supplied from the liquid supply container 200 using the image information acquired by the imaging device 300, the control section 30 performs determination without having a radio tag on the liquid supply container 200 and an uneven shape for determination. Therefore, the liquid supply container 200, which is an environment-friendly consumable item, can be used. As a result, the user can replenish the liquid from the liquid supply container 200 to the liquid container 113 through the liquid fill port 114.

Figure 10:
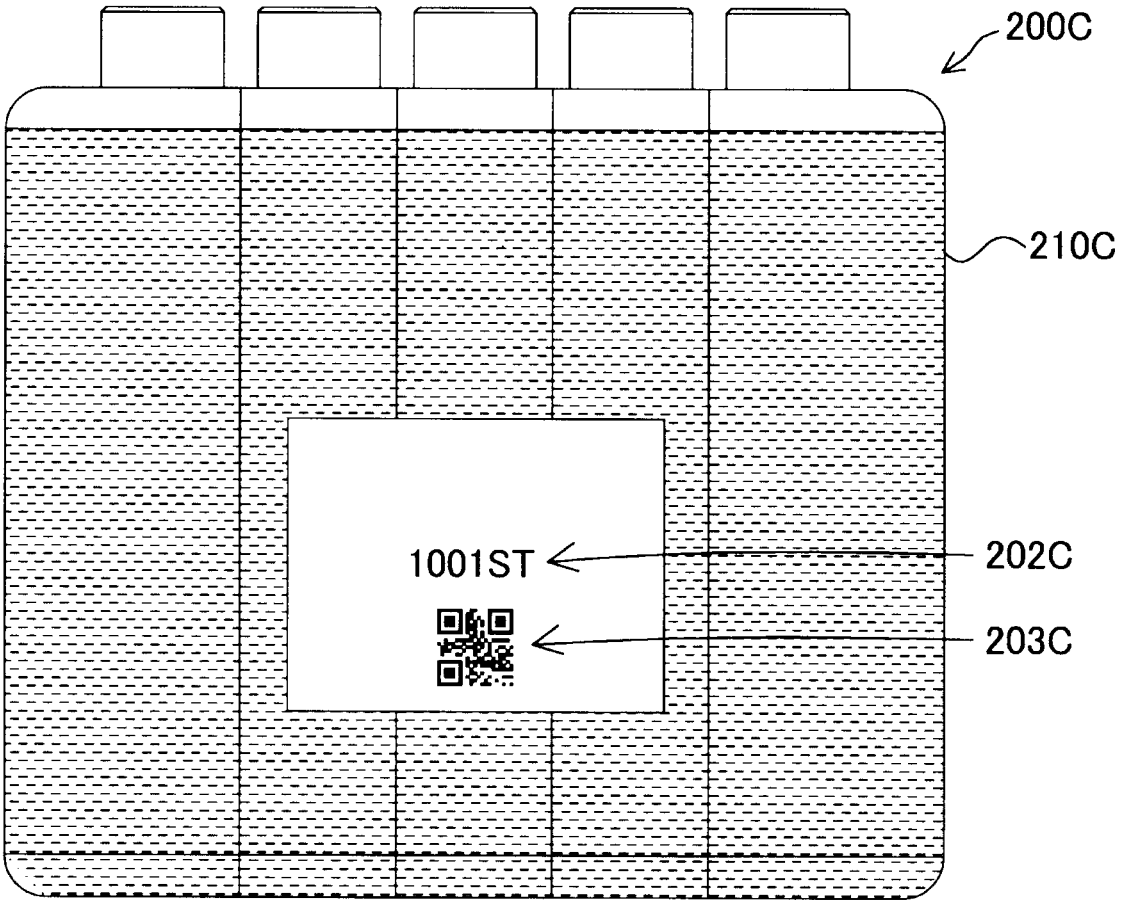
FIG. 10 is an explanatory diagram illustrating another example of the liquid supply container.

D. Other Embodiments (D1) FIG. 10 is an explanatory diagram illustrating another example of a liquid supply container 200C. In the first embodiment, the liquid supply container 200, which is a container storing one type of liquid, that is, the liquid supply container 200C instead of an ink bottle of one color may be a container integrated with storing sections each storing two types of liquids as illustrated in FIG. 10. Since the liquid supply container 200C can simultaneously supply the liquid to a plurality of empty liquid containers 113 when the printing device 100 is used first, the liquid can be more efficiently supplied. The liquid supply container 200C includes a transparent or translucent wall portion 210C that allows the residual amount of the stored liquid to be visually recognized. Further, character information 202C and code information 203C are printed on the liquid supply container 200C.

Figure 11:
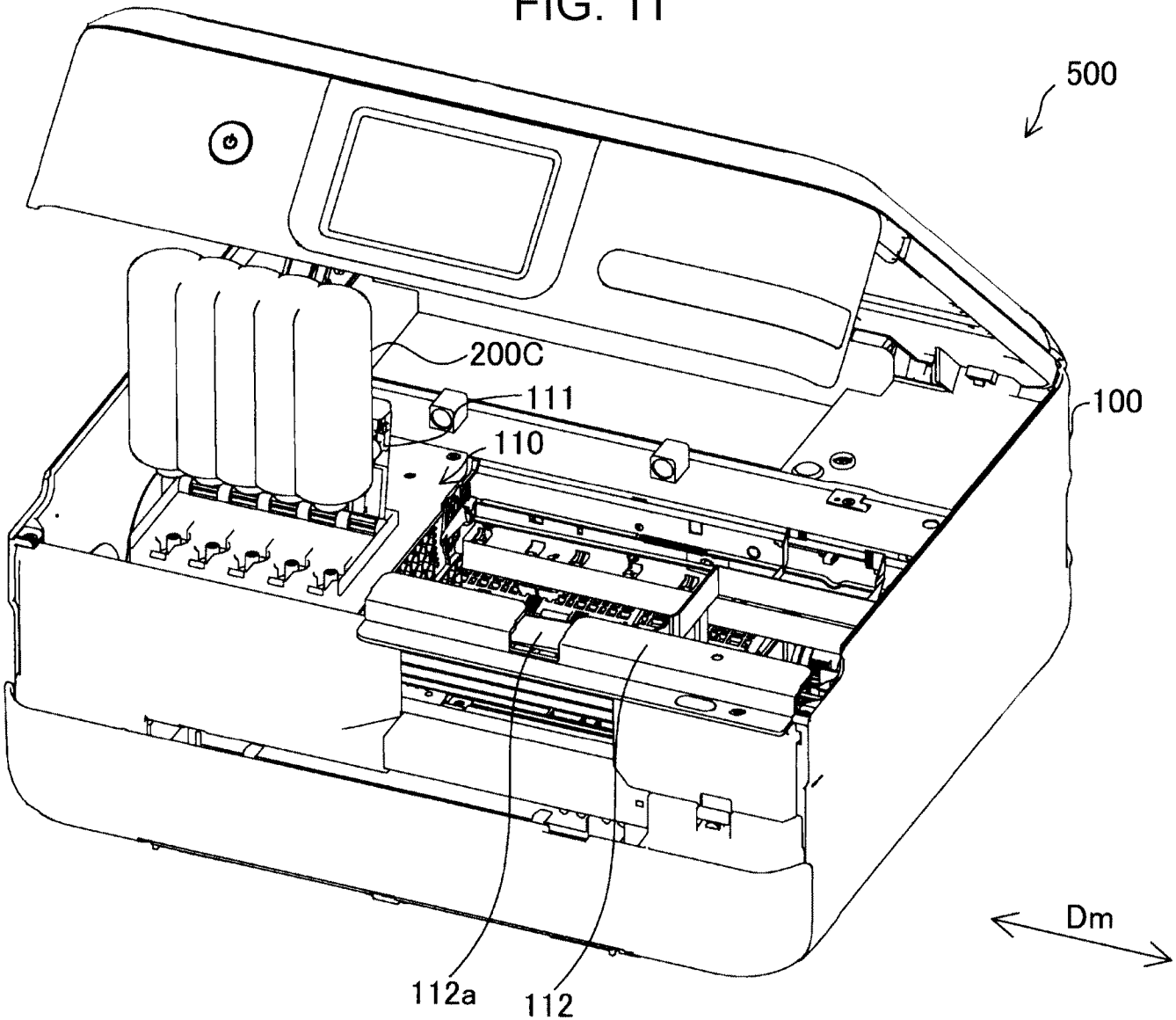
FIG. 11 is an explanatory diagram illustrating another example of the replenishing processing.

FIG. 11 is an explanatory diagram illustrating an example of the replenishing processing when the liquid replenishment processing is performed using the liquid supply container 200C. As illustrated in FIG. 11, the control section 30 moves the carriage 110 outside an area where the lock mechanism 112 is positioned, and thus switches the lock mechanism 112 from the first state to the second state so that the entire cover member 111 transitions to the open state.

(D2) In the embodiment, the processing of Steps S100 to S130 may be repeated since determining that the replenishment can be performed in the liquid replenishment processing until the replenishment is completed. That is, even if it is determined that the liquid supply container 200 stores the liquid to be replenished, it is repeatedly determined whether the liquid supply container 200 stores the liquid to be replenished until the replenishment is completed. According to the embodiment, it is possible to avoid the user from replenishing the ink with the different liquid supply containers 200 on the way.

(D3) In the embodiment, the printing device 100 may be notified to the user according to an amount of liquid stored in the liquid supply container 200. For example, by using an amount of liquid stored in the liquid supply container 200 included in the image information acquired by the imaging device 300, the printing device 100 can obtain a time required for replenishment completion or the number of times of printing and notify the user of the time required for replenishment completion or the number of times of printing.

(D4) In the liquid replenishment processing of the embodiment, the printing system 500 may replace an attaching/detaching member as another replaceable consumable item. The attaching/detaching member is, for example, the waste liquid tank 117, the lighting section 130, a display, or the like. The imaging device 300 acquires image information including at least a part of the attaching/detaching member, and the acquisition section 10 acquires reference information regarding the attaching/detaching member. The determination section 20 collates the image information with the reference information, and determines whether or not the attaching/detaching member can be replaced according to the collation result. The control section 30 controls the printing device 100 according to the determination of the determination section 20.

E. Other Aspects

The present disclosure is not limited to the embodiments described above, and may be realized in various forms without departing from the spirit of the disclosure. For example, the present disclosure may be realized in the following aspects. In order to cope with part or all of the problems of the present disclosure or to achieve part or all of the effects of the present disclosure, the technical features in the embodiments corresponding to technical features in the embodiments described hereafter may be substituted, or combined as appropriate. If technical features are not described as indispensable features in the present description, the technical features may be deleted as needed. In the first and third embodiments, the term "replenishment" means supplying the liquid from the liquid supply container 200 to increase a liquid level of the liquid container 113, means filling the empty liquid container 113 with the liquid when the printing device 100 is used first, and means increasing the liquid level in a state where the liquid remains in the liquid container 113. Due to the "replenishment", the liquid level may not be necessarily increased to a full position.

(1) According to an aspect of the present disclosure, there is provided a printing system. The printing system includes a liquid supply container, a printing device that receives a liquid supplied from the liquid supply container and performs printing; at least one imaging device for capturing an image including image information for identifying the liquid supply container; an acquisition section that acquires reference information; a determination section that collates the image information with the reference information and determines whether or not the liquid is allowed to be supplied according to a collation result; and a control section that controls the printing device according to the determination. According to this aspect, since it is determined that whether or not the liquid is allowed to be supplied using the image information without having a RFID (radio frequency identification) tag on the liquid supply container or an uneven shape for determination, a liquid supply container, which is an environment-friendly consumable item, can be used.

(2) In the above-described aspect, the image information may include at least one or more of code information, character information, color information, information regarding a member reflecting infrared rays, and an outer appearance of the liquid supply container, the code information, the character information, and the color information regarding a color of the liquid stored in the liquid supply container. According to this aspect, the control section can more accurately perform the determination.

(3) In the above-described aspect, the at least one imaging device may include a plurality of imaging devices. According to this aspect, since the liquid supply container can be imaged from a plurality of angles, image information with higher accuracy can be acquired.

(4) In the above-described aspect, the liquid supply container may have a wall portion that allows a residual amount of the stored liquid to be visually recognized, the image information may include information regarding the residual amount visually recognized through the wall portion, the determination section may determine the residual amount using the information regarding the residual amount and generates related information using the residual amount, and the printing system may further include a notification section that notifies a user of the related information. According to this aspect, by using the information regarding the residual amount of liquid, for example, a time required for replenishment completion or the number of times of printing can be obtained and notified as the related information.

(5) In the above-described aspect, the imaging device may be attachable to and detachable from the printing device. According to this aspect, the user can use a desired imaging device.

(6) In the above-described aspect, the printing device may include a print head configured to eject the liquid, and a liquid inlet port that communicates with the print head and into which the liquid flows. According to this aspect, the liquid can flow in from the liquid inlet port and can be supplied to the print head. By moving the carriage, printing can be performed.

(7) In the above-described aspect, the print head and the liquid inlet port may be mounted on a carriage movable in a main scanning direction, and the control section may move the carriage to a coupling position where the liquid inlet port and the liquid supply container is coupled when the determination section determines that the liquid is allowed to be supplied. According to this aspect, the user can easily recognize the position where the liquid supply container is coupled.

(8) In the above-described aspect, the captured image may include an image showing a coupling state between the liquid inlet port and the liquid supply container. According to this aspect, it is possible to provide a guide suitable for user's work.

(9) In the above-described aspect, the printing system may further include a notification section that notifies a user of information regarding a coupling method of the liquid inlet port and the liquid supply container when the determination section determines that the liquid is allowed to be supplied. According to this aspect, it is possible to assist user's replenishment work.

(10) In the above-described aspect, the printing device may further include a plurality of liquid inlet ports each of which communicates with the print head and into each of which the liquid flows, and a lighting section provided at a position corresponding to a position where corresponding one of the plurality of liquid inlet ports is provided, and when the determination section determines that the liquid is allowed to be supplied, the lighting section may indicate a position of the liquid inlet port to which the liquid supply container is coupled. According to this aspect, the user can easily recognize the position where the liquid supply container is coupled.

(11) In the above-described aspect, the printing device may further include a cover member movable between a closed state where the cover member covers the liquid inlet port and an open state where the liquid inlet port is exposed, and a lock mechanism that is switchable between a first state where the cover member is not allowed to transition from the closed state to the open state and a second state where the cover member is allowed to transition from the closed state to the open state, and the control section may perform control to switch the lock mechanism from the first state to the second state according to the determination, the lock mechanism corresponding to the liquid inlet port to which the liquid supply container is coupled. According to this aspect, it is possible to prevent the user from coupling the liquid supply container to a wrong position.

(12) According to another aspect of the present disclosure, there is provided a printing system. The printing system may include a printing device that has an attaching/detaching member which is replaceable; an imaging device that acquires image information including at least a part of the attaching/detaching member; an acquisition section that acquires reference information; a determination section that collates the image information with the reference information and determines whether or not the attaching/detaching member is allowed to be replaced according to a collation result; and a control section that controls the printing device according to the determination. According to this aspect, since it is determined that whether or not the attaching/detaching member can be replaced using the image information without having a RFID tag on the attaching/detaching member or an uneven shape for determination, an environment-friendly consumable item can be used.

The present disclosure can be realized in an aspect of a computer program for causing a computer to execute the above method, a non-transitory recording medium recording the computer program, or the like, in addition to the above aspects.

What is claimed is:

1. A printing system, comprising:

a liquid supply container that stores a liquid;

a printing device that receives the liquid supplied from the liquid supply container and performs printing;

at least one imaging device for capturing an image including image information for identifying the liquid supply container;

an acquisition section that acquires reference information;

a determination section that collates the image information with the reference information and determines whether or not the liquid is allowed to be supplied according to a collation result; and a control section that controls the printing device according to the determination.

2. The printing system according to claim 1, wherein the image information includes at least one or more of code information, character information, color information, information regarding a member reflecting infrared rays, and an outer appearance of the liquid supply container, the code information, the character information, and the color information regarding the color of the liquid stored in the liquid supply container.

3. The printing system according to claim 1, wherein the at least one imaging device includes a plurality of imaging devices.

4. The printing system according to claim 1, wherein the liquid supply container has a wall portion that allows a residual amount of the stored liquid to be visually recognized, the image information includes information regarding the residual amount visually recognized through the wall portion, the determination section determines the residual amount using the information regarding the residual amount and generates related information using the residual amount, and the printing system further comprises a notification section that notifies a user of the related information.

5. The printing system according to claim 1, wherein the imaging device is attachable to and detachable from the printing device.

6. The printing system according to claim 1, wherein the printing device includes a print head configured to eject the liquid, and a liquid inlet port that communicates with the print head and into which the liquid flows.

7. The printing system according to claim 6, wherein the print head and the liquid inlet port are mounted on a carriage movable in a main scanning direction, and the control section moves the carriage to a coupling position where the liquid inlet port and the liquid supply container is coupled when the determination section determines that the liquid is allowed to be supplied.

8. The printing system according to claim 6, wherein the captured image includes an image showing a coupling state between the liquid inlet port and the liquid supply container.

9. The printing system according to claim 6, further comprising a notification section that notifies a user of information regarding a coupling method of the liquid inlet port and the liquid supply container when the determination section determines that the liquid is allowed to be supplied.

10. The printing system according to claim 6, wherein the printing device further includes a plurality of liquid inlet ports each of which communicates with the print head and into each of which the liquid flows, and a lighting section provided at a position corresponding to a position where corresponding one of the plurality of liquid inlet ports is provided, and when the determination section determines that the liquid is allowed to be supplied, the lighting section indicates a position of the liquid inlet port to which the liquid supply container is coupled.

11. The printing system according to claim 6, wherein the printing device further includes a cover member movable between a closed state where the cover member covers the liquid inlet port and an open state where the liquid inlet port is exposed, and a lock mechanism that is switchable between a first state where the cover member is not allowed to transition from the closed state to the open state and a second state where the cover member is allowed to transition from the closed state to the open state, and the control section performs control to switch the lock mechanism from the first state to the second state according to the determination, the lock mechanism corresponding to the liquid inlet port to which the liquid supply container is coupled.

12. A printing system, comprising:

a printing device that has an attaching/detaching member which is replaceable;

an imaging device that acquires image information including at least a part of the attaching/detaching member;

an acquisition section that acquires reference information;

a determination section that collates the image information with the reference information and determines whether or not the attaching/detaching member is allowed to be replaced according to a collation result; and a control section that controls the printing device according to the determination.

* * * * *